US006417651B1

(12) United States Patent
Kronberg

(10) Patent No.: US 6,417,651 B1
(45) Date of Patent: Jul. 9, 2002

(54) DIGITALLY-CONTROLLED AC VOLTAGE STABILIZER

(76) Inventor: James W. Kronberg, 108 Independent Blvd., Aiken, SC (US) 29803

( * ) Notice: Subject to any disclaimer, the term of this patent is extended or adjusted under 35 U.S.C. 154(b) by 0 days.

(21) Appl. No.: 09/847,815

(22) Filed: May 2, 2001

Related U.S. Application Data

(60) Provisional application No. 60/201,212, filed on May 2, 2000.

(51) Int. Cl.[7] ..... G05F 1/14
(52) U.S. Cl. ..... 323/255
(58) Field of Search ..... 323/255, 256, 323/257, 258, 340, 341

(56) References Cited

U.S. PATENT DOCUMENTS 3,818,402 A * 6/1974 Golaski et al. ..... 336/150
5,825,164 A * 10/1998 Williams ..... 323/255
5,900,764 A * 5/1999 Imam et al. ..... 327/343

* cited by examiner

*Primary Examiner*—Matthew Nguyen

(57) ABSTRACT

A voltage stabilizer apparatus with digitally-controlled emulation of servotransformer operation to provide smooth voltage control. Tap-switching on both the primary and the secondary sides of a transformer allows a small number of relays to provide a large number of voltage step-up and step-down ratios. The maximum number of achievable ratios is equal to $N_{max}=(m*n-p+1)$ where m is the number of primary taps, n the number of secondary taps, and p the number of taps which are common to both sets. The taps are preferably placed at approximately logarithmic intervals along the transformer winding to provide evenly-spaced step-up and step-down ratios. Additional components may include devices for sensing under- or over-voltages, preventing unwanted cycling under load, rectifiers, arc-suppression devices, circuitry for interfacing with the user's electronic equipment, and LEDs or other indicators for providing feedback on the operational state of the apparatus.

20 Claims, 5 Drawing Sheets

DIGITALLY-CONTROLLED AC VOLTAGE STABILIZER

This application claims priority from provisional application Ser. No. 60/201,212, filed May 2, 2000.

BACKGROUND OF THE INVENTION

1. Field of the Invention

The present invention relates to a voltage stabilizer apparatus for use with alternating current (AC) power sources. In particular, the present invention relates to an AC voltage stabilizer with digitally-controlled emulation of servotransformer operation using tap-switching technology.

2. Discussion of Background

AC power lines are subject to a number of different types of voltage disturbances. These include spikes (i.e., pulses of very high voltage and current), which are most commonly caused by lightning and usually last less than a second; surges and sags, which are periods of less severe, too-high or too-low voltage lasting from several seconds to a few minutes, usually caused by faulty power company switching or by other devices on the line; brownouts, which are longer sags lasting from several minutes to several hours; and blackouts, which are periods of near-zero voltage, which can be caused by blown fuses or tripped circuit breakers after a lightning strike or other line problem.

Users of computers and other electronic equipment are familiar with the problems caused by power-line spikes and surges. So-called "surge-suppressing" (more correctly, "spike-suppressing") power strips or adapters are now widely available. However, these devices are of little value in protecting against sustained power-line surges and of none at all against sags or brownouts. In areas where severe sags, surges or brownouts occur frequently, voltage-sensitive devices such as motors, computers and other electronic equipment, and even ordinary light bulbs have a limited life expectancy. These problems are ubiquitous in the historically less-developed countries, and even in remote areas of the developed countries where generators or long stretches of low-tension cable may be needed to provide electrical power. In many countries, the infrastructure needed to support widespread use of these technologies is inadequate. In particular, the lack of steady, dependable electrical power has proved to be an important factor in limiting the potential market for electrically-powered consumer goods (refrigerators, air conditioners, television sets, personal computers, etc.).

Many methods and devices are available for stabilizing local line voltage, but typically represent difficult compromises, playing off smoothness and accuracy of control against cost. Most commercially-available voltage stabilizers rely on transformers whose step-up or step-down ratios can be changed to help compensate for input-voltage changes. These devices fall into two broad classes: discrete tap switchers or "relay boxes," and servo-transformers.

Tap switchers are simple and inexpensive, but do not provide smooth voltage regulation. In such a device, one or more relays select various taps of a transformer (typically an autotransformer) so that the output voltage is raised or lowered in steps to help compensate for changes in the input voltage. This principle is illustrated in FIG. 1A for a nominal 230-volt line using a single relay, where an autotransformer 10 is provided with three taps 12, 14 and 16, arranged so that an AC voltage applied between taps 12 and 14 results in a higher ("stepped-up") voltage appearing between taps 14 and 16. (For clarity, transformer 10, an iron-cored AC power transformer, is shown as a simple coil or series of windings in FIG. 1A and the following Figures.) The selected step-up ratio depends upon the particular application, but is typically within the range of about 10–30%.

In an unbalanced circuit, the AC (alternating current) hot line is normally connected to tap 12 through a terminal 12*a,* and the neutral line to tap 14 through a terminal 14*a.* A relay 20 connects either the input voltage at tap 12 or the stepped-up voltage at tap 16 to a terminal 22. Relay 20 is driven by a control circuit (represented schematically as 24) which selects tap 12 when the input voltage is generally above a threshold 26, or tap 16 when the input voltage is generally below this threshold. By "generally" it is meant that the control is not exact; hysteresis effects are usually present, and indeed are desirable to prevent relay chatter and prolong the life of relay 20. The output is then taken between terminal 22, which is the new AC hot line, and neutral output terminal 14*b.* Threshold 26 is chosen so that the output voltage remains in the vicinity of a selected voltage represented by a line 36 (FIG. 1B), over a wider range of input voltages than if no compensation were made.

The result is shown graphically by line segments 30, 32 and 34 (FIG. 1B). When the input voltage is below threshold 26, and neglecting the effects of loading, relay 20 selects tap 16. The output voltage measured between taps 14 and 16 is higher than the input voltage by the step-up factor of transformer 10, typically between about 10–30%, as shown by line segment 30. As the input voltage rises above threshold 26, control circuit 24 causes relay 20 to change position, selecting tap 12 instead of tap 16, and the output voltage changes abruptly as shown by line 32. At still higher input voltages, the output equals the input as shown by line segment 34.

If the input voltage then drops below threshold 26, relay 20 again changes position to select tap 16 and the output voltage is again stepped up to compensate for the input voltage drop. For comparison, line segment 38 represents the output voltage if no compensation is made.

When transformer 10 is supplying current to a load, the graph shown in FIG. 1B is not completely accurate since some voltage drop occurs within the transformer, and the output voltage is correspondingly lower. Hence, selecting the transformer tap according to the output voltage, rather than the input, would in theory provide superior control. In commercial tap switchers, however, this is not often done because it can cause oscillation between positions, so that the "stabilizer" actually makes the output voltage less rather than more stable.

The quality of voltage regulation available from a tap switcher can be improved by adding more steps, so that the intervals between the steps can be made smaller and/or so that a wider span of input voltages can be handled. More steps, however, require correspondingly more relays and transformer taps, resulting in greater circuit complexity and higher cost. These types of devices normally operate in simple "daisy-chain" fashion, so that a separate tap and relay are required for each step.

For example, FIG. 2A illustrates a tap switcher using an autotransformer 10 with four taps (not separately labeled) and three relays 20*a,* 20*b,* and 20*c* acting successively at three different thresholds 26*a,* 26*b,* and 26*c,* respectively, under the control of circuit 24. Such a stabilizer might, for example, provide either straight-through operation as shown by line segment 34 (FIG. 2B), boosts of 20% or 40% for line undervoltages as shown by line segments 30*a* and 30*b,* respectively, or 20% bucking (voltage decrease) for line overvoltages as shown by line segment 30*c*. Line segments 38*a* and 38*b* represent the output voltage if no compensation were made.

As in the circuit of FIG. 1A, abrupt voltage steps 32*a*, 32*b* and 32*c* occur each time a relay switches. However, a larger number of steps permits either stabilization of the output voltage near a desired level 36 over a wider input voltage range, smaller individual steps so that the output voltage remains closer to level 36 over this range, or both.

Some products designed mostly for audiophile or recording-studio use perform a similar function to the circuits of FIGS. 1A and 2A using solid-state switching devices rather than electromechanical relays. This approach speeds response and minimizes switching noise, but tends to be quite costly because of the added complexity of the circuitry.

Servo-transformers provide much better and smoother, nearly stepless regulation than tap switchers, but at the cost of greater mechanical complexity, higher price, and relatively slow response. Such a device and its voltage response are shown in FIGS. 3A and 3B. Instead of multiple discrete taps, autotransformer 10 is typically equipped with only two taps 12 and 14 plus a sliding brush 50 which is able to contact any selected one of the transformer windings. This is usually accomplished by winding transformer 10 with heavy copper wire on a ring-shaped armature, then grinding one end surface flat (including all windings) so that the flat surfaces of successive windings lie in a common ring-shaped plane. The ground surfaces of the windings are usually plated with a precious metal to prevent tarnishing. The brush, which is usually made of graphite, is mounted on a pivoting arm so that, as the arm rotates, the brush contacts each winding in turn.

As brush 50 moves along the windings of transformer 10, and with an AC voltage applied between taps 12 and 14, the step-up or step-down ratio depends upon the position of brush 50. This ratio changes as brush 50 is moved from one winding to another. Typically, one tap 14 is located at an end of the winding and serves as a common neutral, while the other tap 12 is located partway along the winding and serves as the hot input. Brush 50 is connected to output terminal 22. As a result, the ratio of the output to input voltages can be changed from near zero to well above unity in a series of very small steps: one step for each turn of winding 10 which is exposed along the path of brush 50.

A mechanically-variable autotransformer such as this, without other components, is sometimes called a "variac." Because of its mechanical complexity and the grinding and plating operations required in its manufacture, a variac is typically more expensive, as well as significantly larger and heavier, than a multitapped autotransformer with the same overall power rating.

A variac can be made into a voltage stabilizer by adding a servomotor (represented schematically as 52) which moves brush 50 back and forth along the windings of transformer 10 under the control of a circuit 24. Linkage between servomotor 52 and brush 50 is usually through a gearbox or other suitable type of speed reducer 54.

Since the voltage steps are small, feedback control can be used to minimize output-voltage changes as the load varies. Typically, two threshold voltages 60*a* and 60*b* are set up, 60*a* above and 60*b* below a desired output voltage 36, and spaced further apart than the maximum voltage step which occurs on the motion of brush 50 from one winding of transformer 10 to the next adjacent winding. The output voltage is monitored, typically by being rectified, filtered and compared with DC (direct current) references corresponding to these thresholds. Should the output voltage move above level 60*a*, brush 50 is moved to contact a lower-voltage turn of winding 10. Conversely, should the output voltage move above below 60*b*, brush 50 is moved to contact a higher-voltage turn. The output voltage is continually stabilized in this way.

On a rising input voltage, the output voltage repeatedly rises to threshold 60*a* and is corrected downward in small steps throughout the range over which stabilization is possible, as generally indicated by line 62 (FIG. 3B). If the input voltage falls again, the output voltage will repeatedly decrease to threshold 60*b* and be corrected upward in small steps, as generally indicated by line 64. (For purposes of illustration, thresholds 60*a* and 60*b* are shown relatively further apart, and the voltage correction steps in lines 62 and 64 correspondingly larger, than would be typical in a real stabilizer. As in FIG. 1B, line 34 represents the output voltage if no correction were being performed.)

Since a variac can provide voltage step-up or step-down ratios ranging down almost to zero but upward only to some set ratio above unity, the range over which it is possible to keep the output near desired output level 36 ranges from a minimum voltage 66 set by the maximum step-up ratio, upward to a limit 68 determined by the ability of winding 10 to withstand overvoltage. With an input voltage less than voltage 66, the output voltage equals the input voltage multiplied by the maximum step-up ratio as indicated by a line 70. Operation at an input voltage greater than limit 68 should be avoided, since equipment damage could occur.

Because of the need for mechanical motion, correction for input-voltage or load changes in the circuit of FIG. 3A is typically rather slow. If control circuit 24 is improperly designed, moreover, or if thresholds 60*a* and 60*b* are set too close together, brush 50 may move too far before circuit 24 can respond. In such a case, oscillation takes place, the output to the load becomes unstable, and brush 50 may quickly wear out.

The advantage of a servo-transformer voltage stabilizer such as that shown in FIG. 3A is that, since it provides a large number of very small steps, voltage regulation can either be very accurate, be performed over a very wide range of input voltages, or both. Because of its mechanical complexity, however, such a stabilizer is larger, heavier, and more costly than a tap switcher of equal power-handling capacity. Because of the large number of moving parts it contains, it is also more liable to failure and requires much more frequent maintenance.

Response approximating that of a servo-transformer can be achieved using conventional tap-switching technology if a very large number of taps and relays are used. However, because of the expense of so many relays and the complexity of the circuitry needed to drive them, and because the geometry of a conventional power transformer limits the number of taps which can be placed on its windings to a dozen or so, this is not achievable at reasonable cost.

Additional types of voltage stabilizers use devices such as ferroresonant transformers. These provide much smoother voltage regulation and have no moving parts, but are cumbersome, relatively costly, and often generate a continuing audible hum that is annoying to many listeners.

There is a need for a voltage stabilizer apparatus that provides smooth, noise-free regulation in a relatively small, lightweight package, at low cost and with high power efficiency.

SUMMARY OF THE INVENTION

According to its major aspects and broadly stated, the present invention is a voltage stabilizer apparatus that uses cost-effective, digitally-controlled emulation of servotransformer operation to provide smooth voltage control. The invention makes use of tap-switching on both the primary and the secondary sides of a transformer, thereby allowing a relatively small number of relays to provide a relatively large number of voltage step-up and step-down ratios.

An important feature of the present invention is the use of tap-switching technology to emulate servotransformer operation, that is, to "servo" a voltage up or down under control of a feedback loop. In a conventional tap switching circuit, the number of step-up and step-down ratios is equal to the number of relays used to perform the switching, that is, one less than the number of taps. By switching on both the primary and secondary sides of an autotransformer, the maximum number of achievable ratios is increased to $N_{max}=(m*n-p+1)$ where m is the number of primary taps, n the number of secondary taps, and p the number of taps which are common to both sets. For m=n=p=5, for example, there are 21 possible ratios, more than four times as many as for a conventional tap switcher with 5 relays. For m=n=p=10, the invention offers 91 possible ratios instead of the 9 afforded by a conventional device.

Another feature of the present invention is the spacing of the taps. For an approximately evenly spaced series of step-up and step-down ratios, the taps are placed at logarithmic (or approximately logarithmic) intervals along the transformer winding. Two overlapping sets of such taps can be used: one set placed at a basic narrow spacing ratio $R_n$ and the other at a wider spacing ratio Rw, so that combinations of the two sets form ratios at approximately equal logarithmic spacing. Using one set of taps as the inputs and the other set as the outputs then gives the desired succession of ratios.

Still another feature of the present invention is the ability to add additional components to the apparatus, including but not limited to devices for sensing under- or over-voltages, devices for preventing unwanted cycling under load, rectifiers, arc-suppression devices, and circuitry for interfacing with the user's electronic equipment. If desired, LEDs or other indicators may be included for providing feedback on the operational state of the voltage stabilizer apparatus.

Other features and advantages of the present invention will be apparent to those skilled in the art from a careful reading of the Detailed Description of Preferred Embodiments presented below and accompanied by the drawings.

BRIEF DESCRIPTION OF THE DRAWINGS

In the drawings,

FIGS. 8–13 illustrate the components of a voltage stabilizer circuit according to another preferred embodiment of the present invention, wherein FIG. 8 shows a tap selecting circuit, FIG. 9 shows a rectifying and averaging circuit, FIG. 10 shows a voltage comparator circuit and subsequent control logic, FIG. 11 shows an electromechanical relay coil with a driver, FIG. 12 shows an arc suppression network, and FIG. 13 shows a low-pass resonant filter.

DETAILED DESCRIPTION OF PREFERRED EMBODIMENTS

Figure 1A:
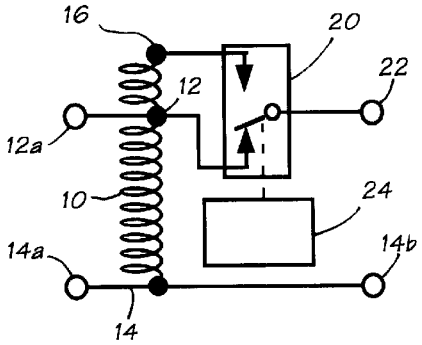
Fig. 1A prior art
FIG. 1A is a circuit diagram of a tap switching circuit.
Figure 1B:
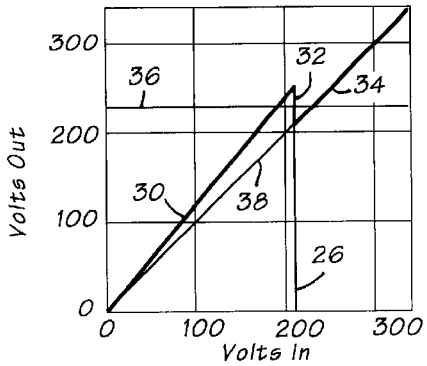
Fig. 1B prior art
FIG. 1B is a graph of the output voltage vs. the input voltage of the circuit of FIG. 1A.
Figure 2A:
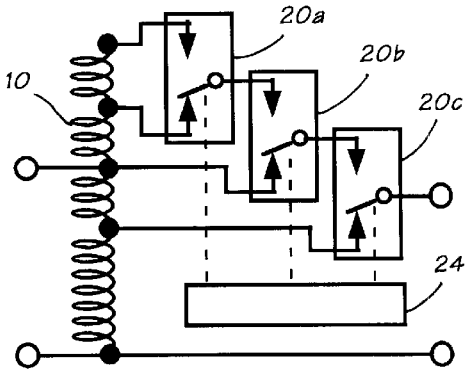
Fig. 2A prior art
FIG. 2A is a diagram of another tap switching circuit.
Figure 2B:
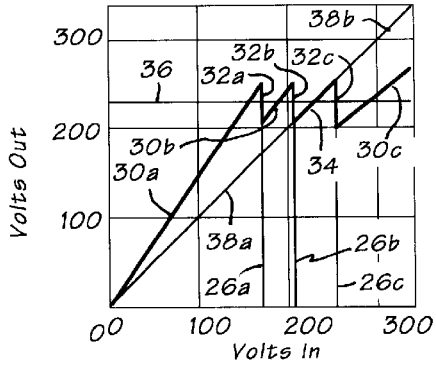
Fig. 2B prior art
FIG. 2B shows the output voltage vs. the input voltage of the circuit of FIG. 2A.
Figure 3A:
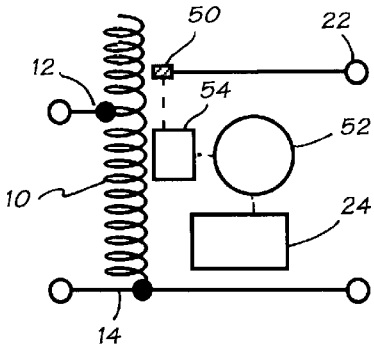
Fig. 3A prior art
FIG. 3A shows a typical servo-transformer.
Figure 3B:
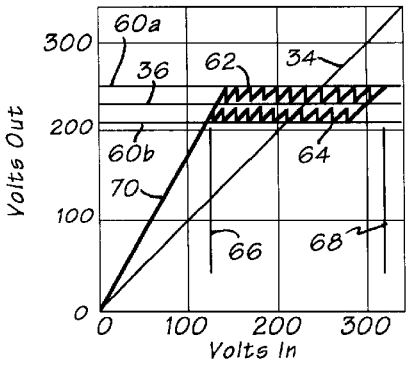
Fig. 3B prior art
FIG. 3B shows the output voltage vs. the input voltage of servo-transformer of FIG. 3A.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," "left," "right," "up," "down," as well as adjectival and adverbial derivatives thereof, refer to the relative orientation of the illustrated structure as the particular drawing figure faces the reader.

Conventional tap-switching voltage stabilizers perform switching only on the secondary side of the transformer: that is, the number of turns to which the input voltage is applied is not varied. Hence, the maximum number of steps achievable with this technology equals the number of relays used to perform the switching, and is one less than the number of taps. In essence, the available voltage step-up or step-down ratios are $N_1/N_x$, $N_2/N_x$, $N_3/N_x$, . . . , $N_y/N_x$ where $N_1$, $N_2$, . . . , $N_y$ are the numbers of turns in each secondary winding (that is, between each of taps 1 through y and neutral) and $N_x$ is the number of turns in the primary winding between the tap used as the hot input and neutral. The maximum number of available ratios thus equals the number of taps.

If, however, switching could be performed on both the primary and the secondary sides of the transformer, the number of available step-up and step-down ratios would be much greater. These ratios would then be given by a rectangular matrix such as that of Table 1. Excluding all but one of the "unity" ratios (that is, ratios $N_x/N_y$ where x=y), the maximum number of achievable ratios would now be given by $N_{max}=(m*n-p+1)$ where m is the number of primary taps, n the number of secondary taps, and p the number of taps which are common to both sets. For example, for m=n=p=5, there are 21 possible ratios. Sample multitap switching step-up/step-down ratios for this configuration are shown in Table 1.

TABLE 1

Sample multitap switching step-up/step-down ratios for $N_1$ = 100, $N_2$ = 120, $N_3$ = 150, $N_4$ = 180, $N_5$ = 220.

| # Turns (primary winding) | # Turns (secondary winding) 100 | 130 | 160 | 180 | 200 |
|---|---|---|---|---|---|
| 100 | 1.00 | 1.30 | 1.60 | 1.80 | 2.00 |
| 130 | 0.77 | 1.00 | 1.23 | 1.38 | 1.54 |
| 160 | 0.63 | 0.81 | 1.00 | 1.13 | 1.25 |
| 180 | 0.56 | 0.72 | 0.89 | 1.00 | 1.11 |
| 200 | 0.50 | 0.65 | 0.80 | 0.90 | 1.00 |

The resulting step-up and step-down ratios in ascending order are: 0.50, 0.56, 0.63, 0.65, 0.72, 0.77, 0.80, 0.81, 0.89, 0.90, 1.00 (five times), 1.11, 1.13, 1.23, 1.25, 1.30, 1.38, 1.54, 1.60, 1.80, 2.00. These ratios are very unevenly spaced, having successive ratios between them as low as 1.0125 (from 0.80 to 0.81) or as high as 1.12 (0.50 to 0.56). As a result, some steps would be smaller than others, so that the transformer's voltage-correcting ability would be inefficiently used.

In order to take maximum advantage of this scheme, therefore, it would be necessary to determine those values of m, n, and $N_1$–$N_y$ which provide a series of step-up and step-down ratios which are themselves spaced with approximately the same ratio between successive ones. Surprisingly, this problem can be solved by placing taps at two overlapping sets of logarithmic intervals along the transformer winding: one set placed at a basic narrow spacing ratio $R_n$ and the other at a wider spacing ratio Rw, so that combinations of the two sets form ratios at equal logarithmic spacing, covering the region of interest with no gaps wider than $R_n$ and with a minimum number of ratios repeated. Any individual tap may thus belong to the "narrow" set, the "wide" set, or both sets at once. Using one set as the inputs and the other as the outputs then gives the desired succession of ratios.

For example, to provide output voltage stabilization with a nominal accuracy of ±2%, one set of taps is placed at a narrow spacing ratio $R_n$ of 1.04, while another is placed at a wider spacing $R_w=R_n^k$, where k is an integer. As will be explained further below, it is convenient to make this k=4, so that $R_w=R_n^4$.$R_w$ is thus ideally 1.16986 . . . , or very nearly 1.17. Since taps must be separated by integral (or sometimes half-integral) numbers of transformer turns, however, neither of these turns ratios is precisely achievable in reality, and the successive ratios merely approximate these ideal values. If the tap nearest neutral is separated from it by "K" turns, it is convenient to label this tap "$R_n^0$" and the other taps "$R_n^p$", where "p" represents the distance from the first tap expressed in logarithmic intervals of $R_n$ and rounded to the nearest whole (or half) turn. An example of such a set of tap spacings (expressed as turns numbers) and the resulting step-up and step-down ratios is given in Table 2.

TABLE 2

Sample multitap switching step-up/step-down ratios: narrow spacing $R_n$ = 1.04; wide spacing $R_w = R_n^4$ = 1.17

| # Turns (primary winding) | # Turns (secondary winding) 100 | 104 | 108 | 112 |
|---|---|---|---|---|
| 73 | 1.37 | 1.42 | 1.48 | 1.53 |
| 85 | 1.18 | 1.22 | 1.27 | 1.32 |

TABLE 2-continued

Sample multitap switching step-up/step-down ratios: narrow spacing $R_n$ = 1.04; wide spacing $R_w = R_n^4$ = 1.17

| # Turns (primary winding) | # Turns (secondary winding) 100 | 104 | 108 | 112 |
|---|---|---|---|---|
| 100 | 1.00 | 1.04 | 1.08 | 1.12 |
| 117 | 0.85 | 0.89 | 0.92 | 0.96 |

Tap labeling, in $R_n^p$ notation: K=73, $R_n$=1.04, 73=$R_n^0$, 85=$R_n^4$, 100=$R_n^8$, 104=$R_n^9$, 108=$R_n^{10}$, 112=$R_n^{11}$, 117=$R_n^{12}$. The resulting ratios in ascending order are: 0.85, 0.89, 0.92, 0.96, 1.00 (once), 1.04, 1.08, 1.12, 1.18, 1.22, 1.27, 1.32, 1.37, 1.42, 1.48, 1.53.

The ratios between successive pairs of these values all lie between 1.029 and 1.047, with the errors largely balancing out as wider intervals are considered. Larger numbers of turns in the windings would allow these errors to be reduced still further.

For purposes of AC line voltage correction, it makes little difference which set of taps is used on the primary side and which is used on the secondary side. However, since lower-voltage analog and digital electronics are used in relay control, there is some advantage in spacing the primary taps at $R_w$ and the secondary taps at $R_n$ so that less overall voltage variation occurs across the primary winding from one end of the stabilization range to the other. One or more auxiliary taps placed between $R_n^0$ and neutral, optionally supplemented by another one or more taps placed on an extension of the windings beyond neutral so as to have an opposite phase relationship, can then supply low-voltage AC for rectification and regulation to a constant DC voltage using simple, conventional means.

Figure 4A:
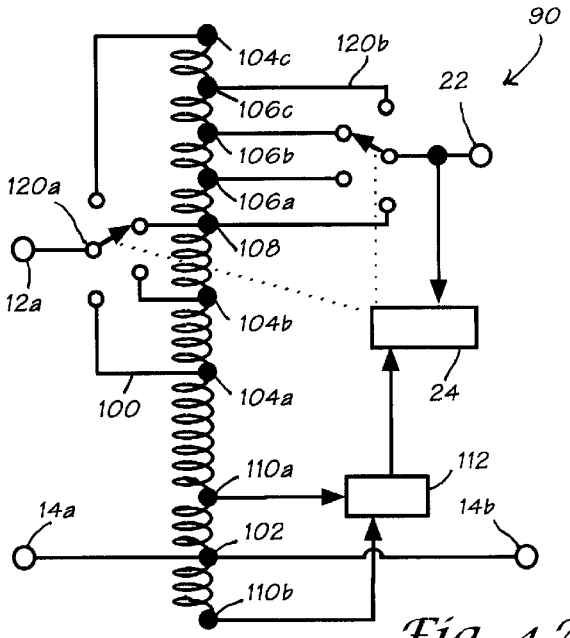
FIG. 4A is a voltage stabilizer with a multitapped autotransformer according to a preferred embodiment of the present invention.

Referring now to FIG. 4A, there is shown a voltage stabilizer 90 according to the present invention. Voltage stabilizer 90 includes a premultitapped autotransformer 100 made according to the above-described approach, along with other components of the stabilizer. A tap 102 is neutral; primary taps 104*a,* 104*b* and 104*c* are denoted by $R_n^0$, $R_n^4$ and $R_n^{12}$, respectively, in the nomenclature set forth above; secondary taps 106*a,* 106*b* and 106*c* are denoted by $R_n^9$, $R_n^{10}$ and $R_n^{11}$; a tap 108 can serve either as a primary or as a secondary tap, and is denoted by $R_n^8$; and taps 110*a* and 110*b* are low-voltage AC taps having opposite phase relationships and used to power the control circuits 24 through a rectifier and regulator 112.

A primary tap-selecting device 120*a* is connected to AC hot input 12*a* and connects it in turn to any one of primary taps 104*a,* 104*b,* 108 or 104*c.* Similarly, a secondary tap-selecting device 120*b* is connected to output terminal 22 and connects it in turn to any one of secondary taps 108, 106*a,* 106*b* or 106*c.* The interaction of the two tap-selecting devices 120*a,* 120*b* thus permits any step-up or step-down ratio between $R_n^{-4}$ (tap 104*c* primary, tap 108 secondary) and $R_n^{11}$ (tap 104*a* primary, tap 106*c* secondary), inclusive, to be selected. In other words, the circuit as shown offers the selection of eleven different step-up ratios for use during voltage sags or brownouts, straight-through operation for periods of near-nominal line voltage, and four step-down ratios for use during voltage surges, as shown in Table 3. The resulting regulation tolerance and range of acceptable input voltages are determined chiefly by the value chosen for $R_n$ in designing the transformer.

TABLE 3

Result of multitap switching in the circuit of FIG. 4: step-up/step-down ratios with $R_n$ = 1.04.

| Selected Primary Tap | Selected Secondary Tap | | | |
|---|---|---|---|---|
| | $R_n^8$ | $R_n^9$ | $R_n^{10}$ | $R_n^{11}$ |
| $R_n^{12}$ | 0.85 | 0.89 | 0.92 | 0.96 |
| $R_n^8$ | 1.00 | 1.04 | 1.08 | 1.12 |
| $R_n^4$ | 1.18 | 1.22 | 1.27 | 1.32 |
| $R_n^0$ | 1.37 | 1.42 | 1.48 | 1.53 |

The output voltage from terminal 22 is also fed to control circuit 24. A circuit 24 usable with the invention is shown in block-diagram form in FIG. 5 (it should be understood that this is an example only; other circuits, both analog and digital, may also be suitable for use with the invention). First, a divider circuit 140 reduces the raw AC voltage at terminal 22 to a level more easily handled by analog integrated circuits such as operational amplifiers. This voltage is then processed by a rectifier 142 and a low-pass filter 144. Either of blocks 142 and 144 may be of any convenient type, and may have either a linear or nonlinear response of any convenient form so long as the output from filter 144 has a unique DC value for each different input AC voltage and the relationship between the two is monotonic over the full range of interest. These functions are conveniently carried out using neutral line 14 as common or signal ground.

A change in the AC input voltage does not cause an instantaneous change in the DC output of filter 144. Rather, at least one full power cycle must be averaged. Where non-periodic disturbances such as lightning spikes or switching transients are present, a longer averaging period may be desirable. Care should be taken in the design of rectifier 142 and filter 144 to minimize the resulting delay.

Figure 4B:
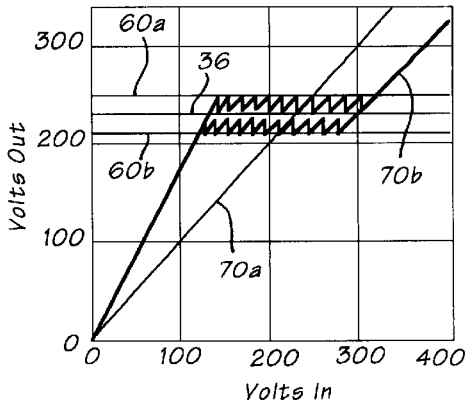
FIG. 4B shows the output vs. the input voltage of the circuit of FIG. 4A.

The output of filter 144 is then compared with a pair of DC reference voltages by comparators 146*a* and 146*b*. The reference voltages may be supplied by a voltage divider 148 or other suitable device. As illustrated in FIG. 4B, these voltages represent upper and lower limits 60*a* and 60*b* between which it is desired to stabilize the output voltage, close to optimal value 36.

The results of the comparison cause a digital emulation of a motor's action, incrementing or decrementing the count in an up/down counter 150. Counter 150 is preferably binary, for example, a CD4029-type, 4-bit CMOS up/down counter, which can hold counts ranging from 0000 to 1111 inclusive. However, other counters may also be suitable.

A supplementary "stop" logic 152 prevents the count from ascending beyond a set maximum value or descending beyond a set minimum value so that no abrupt rollover from maximum to minimum counts occurs. For a CD4029 counter, for example, these values may be set at 1111 and 0000, respectively. Logic 152 monitors binary outputs 154 of counter 150 and ensures that with a below-optimum input voltage, the count increases steadily until the input voltage becomes optimum or until the maximum permitted count has been reached. Similarly, with an above-optimum input voltage, the count decreases steadily until the input voltage becomes optimum or until the minimum permitted count has been reached. When the voltage becomes optimum—that is, between the two limits represented by voltages 60*a* and 60*b*—no counting occurs and the counter maintains whatever value it holds.

As noted above, the wider tap-ratio spacing $R_w$ is made equal to $R_n$ raised to some integral power, and this power is conveniently made equal to four so that $R_w=R_n^4$. The advantage of this is that the last two (least significant) bits of the binary count can now select one of four secondary-winding taps separated successively by $R_n$, while the higher-order bits can select from a number of primary-winding taps separated successively by $R_w=R_n^4$. This number is also conveniently made four, so that a total of four bits, as provided by the CD4029 or a similar device, suffices for control with sixteen available voltage ratios according to the scheme shown in Table 3. For example, if primary taps are set at $R_n^0$, $R_n^4$, $R_n^8$, and $R_n^{12}$ and secondary taps at $R_n^8$, $R_n^9$, $R_n^{10}$ and $R_n^{11}$, the binary outputs from counter 150 may select among them for a total of sixteen step-up or step-down ratios as listed in Table 4.

Figure 6:
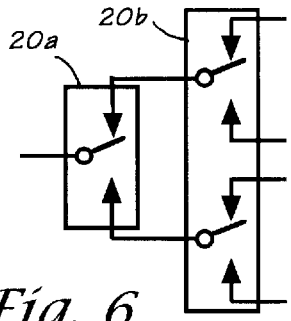
FIG. 6 is a tap-selecting device according to the present invention.

An advantage of this arrangement is that it permits simple selection among four taps using only two relays, as shown in FIG. 6: a single-pole, double-throw (SPDT or "form C") relay 20*a* and a double-pole, double-throw (DPDT or "2 form C") relay 20*b*. Relay 20*a* is controlled by the more-significant bit, and relay 20*b* by the less-significant bit, of two successive outputs from counter 150.

Alternatively, another number of bits may be used either for the primary or the secondary tap selection, or a non-binary type counter (for example, a decimal or binary-coded-decimal counter) may be used as counter 150, with some appropriate tap selection scheme.

The rate at which the count rises or falls is set by a free-running clock 156, which may be of any convenient type and which, once during each clock cycle, permits counter 150 to count up or down if this is warranted by the other conditions just described. Clock 156 is set to the fastest speed which, combined with the response time of filter 144, results in stable operation without oscillation or overshoot.

TABLE 4

Binary Control of Tap Selection and Step-Up/Step-Down Ratios.

| Binary count | Primary tap sel. | Secondary tap sel. | Ratio in $R_n^p$ | Ratio with $R_n$ = 1.04 |
|---|---|---|---|---|
| 0000 | $R_n^{12}$ | $R_n^8$ | $R_n^{-4}$ | 0.85 |
| 0001 | $R_n^{12}$ | $R_n^8$ | $R_n^{-3}$ | 0.89 |
| 0010 | $R_n^{12}$ | $R_n^8$ | $R_n^{-2}$ | 0.92 |
| 0011 | $R_n^{12}$ | $R_n^8$ | $R_n^{-1}$ | 0.96 |
| 0100 | $R_n^8$ | $R_n^9$ | $R_n^0$ | 1.00 |
| 0101 | $R_n^8$ | $R_n^9$ | $R_n^1$ | 1.04 |
| 0110 | $R_n^8$ | $R_n^9$ | $R_n^2$ | 1.08 |
| 0111 | $R_n^8$ | $R_n^9$ | $R_n^3$ | 1.12 |
| 1000 | $R_n^4$ | $R_n^{10}$ | $R_n^4$ | 1.18 |
| 1001 | $R_n^4$ | $R_n^{10}$ | $R_n^5$ | 1.22 |
| 1010 | $R_n^4$ | $R_n^{10}$ | $R_n^6$ | 1.27 |
| 1011 | $R_n^4$ | $R_n^{10}$ | $R_n^7$ | 1.32 |
| 1100 | $R_n^0$ | $R_n^{11}$ | $R_n^8$ | 1.37 |
| 1101 | $R_n^0$ | $R_n^{11}$ | $R_n^9$ | 1.42 |
| 1110 | $R_n^0$ | $R_n^{11}$ | $R_n^{10}$ | 1.48 |
| 1111 | $R_n^0$ | $R_n^{11}$ | $R_n^{11}$ | 1.53 |

Outputs 154 then drive relays or other devices which make up tap-selecting devices 120*a* and 120*b*. For example, each of devices 120*a* and 120*b* may be made up of relays as illustrated in FIG. 6. Often, such a device requires more voltage or current than is available directly from the output of a logic device such as counter 120. Hence, these devices are usually driven through buffer amplifiers 158, which may be of any convenient type.

As will be described below, an arc suppression or voltage limiting device is placed across devices 120*a* and 120*b* to minimize arcing when switching inductive loads. For example, metal-oxide varistors (MOVs) can be connected across the contacts of each relay 20*a,* 20*b,* or between the input and each of the four output terminals of the relay cluster shown in FIG. 6. The MOVs would not only prolong overall relay life, but would also substantially eliminate the possibility of slowed response due to localized welding of the contacts.

Alternatively, devices 120*a* and 120*b* may be replaced by suitable networks of solid-state switching devices, such as silicon controlled rectifiers or triacs. Some additional control circuitry may then be needed to ensure that switching takes place in a "break-before-make" fashion with only one of the four possible connections being made at any given instant. Otherwise, portions of the transformer windings may be shorted out, with potentially catastrophic effects.

Figure 5:
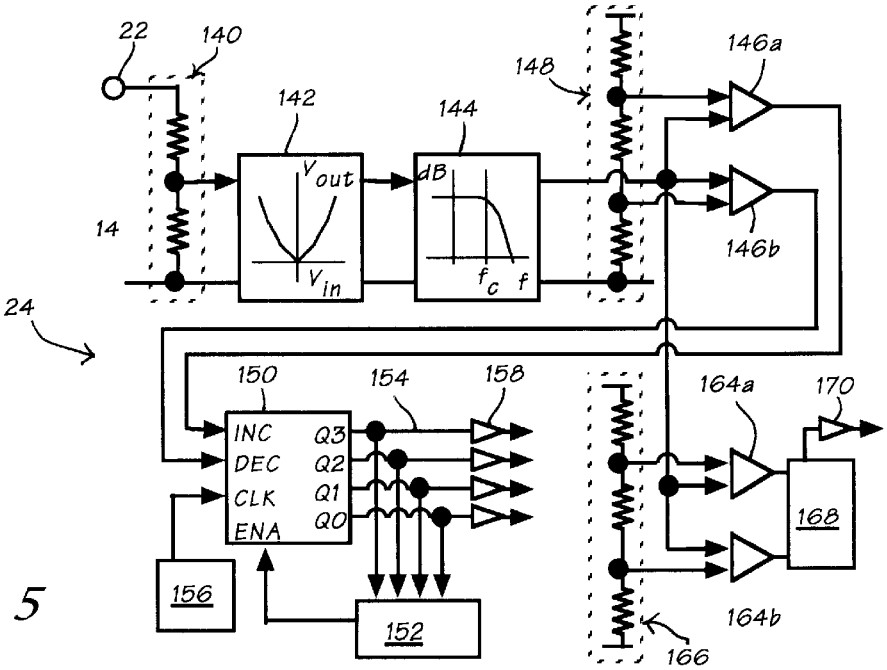
FIG. 5 shows a control circuit according to the present invention.

The circuit shown in FIGS. 4A and 5 does not incorporate any form of control beyond the transformer step-up or step-down range. If a too-high or too-low voltage is input to the circuit, for which adjustment to acceptable output voltages is not possible, the circuit merely goes to its lowest or highest ratio respectively. The result is shown in FIG. 4B: a line segment 70*a* representing circuit performance at too-low voltages goes right down to zero, while a segment 70*b* representing circuit performance at too-high voltages goes up without limit. Operation at too-high or too-low voltages, as was previously noted, can damage or destroy equipment, in this case, the equipment being powered by the stabilizer.

Figure 7B:
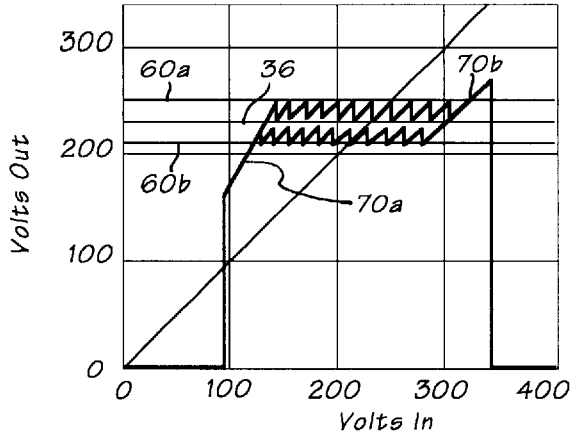
FIG. 7B is a graph of the output vs. the input voltage of the circuit of FIG. 7A.
Figure 7A:
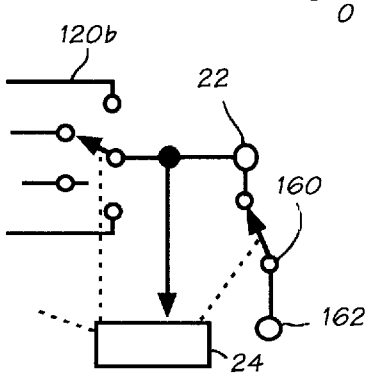
FIG. 7A is another tap-selecting device according to the present invention.

As an added safety feature, as partly shown in FIG. 7A, an additional relay or other switching device 160 is preferably connected between output 22 of tap-selecting device 120*b* (where the feedback voltage is measured) and a final output terminal 162. Device 160 is driven by an auxiliary set of comparators 164*a* and 164*b,* a voltage divider or other source of reference voltages 166, a control circuit 168 and a buffer amplifier 170, sensing under- or overvoltages at output 22 and disabling output 162 if an acceptable output voltage cannot be produced by tap switching. To prevent unwanted cycling under load, at least lower comparator 164*b* preferably includes hysteresis. This safety feature results in the plot of input versus output voltages shown in FIG. 7B; at excessively low or high input voltages, the output is disconnected and falls to zero. Hence, out-of-range performance as represented by line segments 70*a* and 70*b* is limited to safe output voltages.

These functions may be implemented by other suitable techniques. For example, rectifier 142 may be replaced with an RMS (root-mean-square) extracting integrated circuit such as the AD535 or AD536, or blocks 142 and 144 together may be replaced with a peak-detecting circuit having exponential reset to zero with a time constant which is about an order of magnitude longer than the power cycle. Alternatively, the processed voltage may be digitized at some point and some or all of the described functions performed by a microprocessor, digital signal processor (DSP) or similar device. Similarly, any of a wide variety of different analog and digital integrated circuits, discrete-component technologies and combinations of these may be used to implement the functions of blocks 146*a* and 146*b,* 148, 150, 152, 156, 164*a* and 164*b,* 166, 168 and 170.

Referring now to FIGS. 8–12, there is illustrated a preferred embodiment of the present invention using, as nearly as possible, the numbering scheme used in the previous Figures. Depending upon context, the same identifying number may apply to a signal or to the line, node or connected system of lines and nodes on which it appears.

Figure 8:
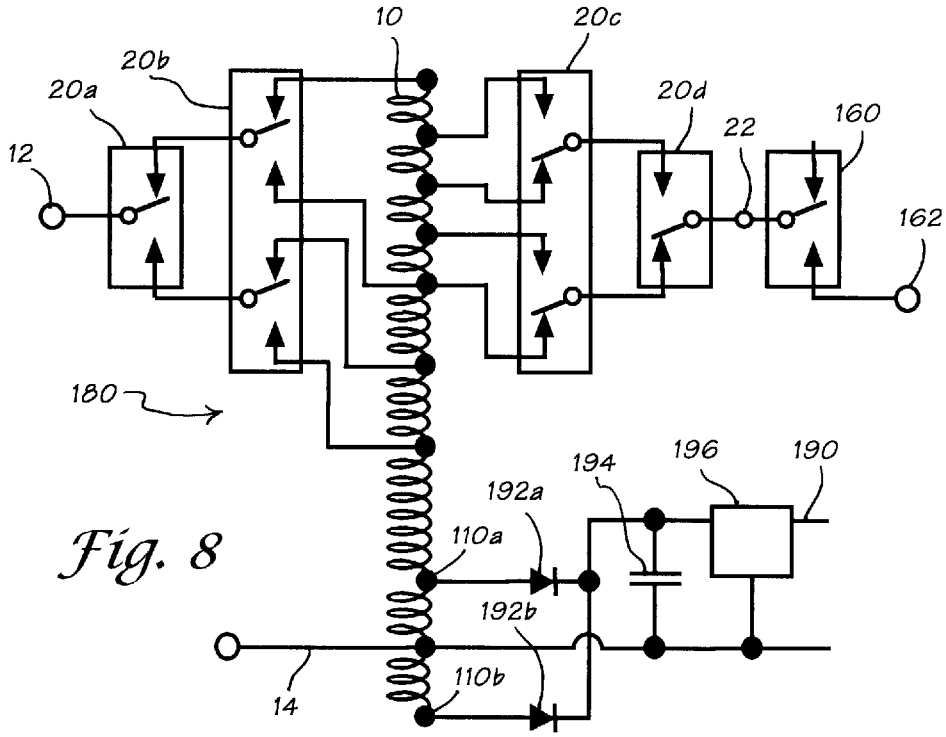

A voltage stabilizer according to the invention includes a tap selecting circuit 180 with a transformer 10, which is made and functions according to the principles described above and illustrated in FIG. 4, using $R_n$=1.04 and Rw=$R_n^4$. As shown in FIG. 8, tap selection is made through two single-pole, double-throw relays 20*a* and 20*d* and two double-pole, double-throw relays 20*b* and 20*c*. A fifth, single-pole, single-throw relay 160 provides the safety disconnect feature to output 162. Low-voltage DC power for the control circuitry, referenced to neutral line 14, is provided to a positive rail 190 through diodes 192*a* and 192*b,* a capacitor 194, and a voltage regulator 196. Diodes 192*a* and 192*b* may be 1N4001's, capacitor 194 an aluminum electrolytic capacitor of at least 3300 μf, and regulator 196 an LM7812 or equivalent, 12-volt positive monolithic regulator. However, other components may also be suitable for use with the invention.

Figure 9:
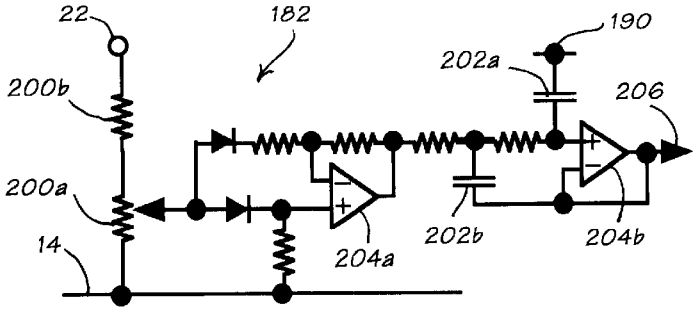

Input AC voltage, after passage through a switch and circuit breaker (not shown) is applied to node 12 at the input of relay 20*a.* Voltage is sampled from node 22 at the output of relay 20*d,* and reduced, full-wave rectified and averaged by a circuit 182 shown schematically in FIG. 9, which corresponds to blocks 140, 142 and 144 of FIG. 5. For example, all resistors shown in FIG. 9 may be 270 KΩ, 5% tolerance, ¼W types except that resistor 200*a* may be a 50 KΩ, 10-turn trimpot and resistor 200*b* chosen so that its value and that of resistor 200*a* total about 6 KΩ per volt at the intended line voltage, resulting in approximately 8 volts RMS across resistor 200*a*. Diodes in this and the following Figures, unless otherwise stated, may be 1N914's or similar devices. Capacitors 202*a* and 202*b* may be 0.1 μf and 0.22 μf, respectively. Operational amplifiers 204*a* and 204*b* may be LM324 or other single-supply types powered by rail 190. The output 206 is a DC level which is approximately linearly related to the input AC voltage but may be adjusted up or down using resistor 200*a*. As for above-described device 180, other circuit components may also be suitable.

Figure 10:
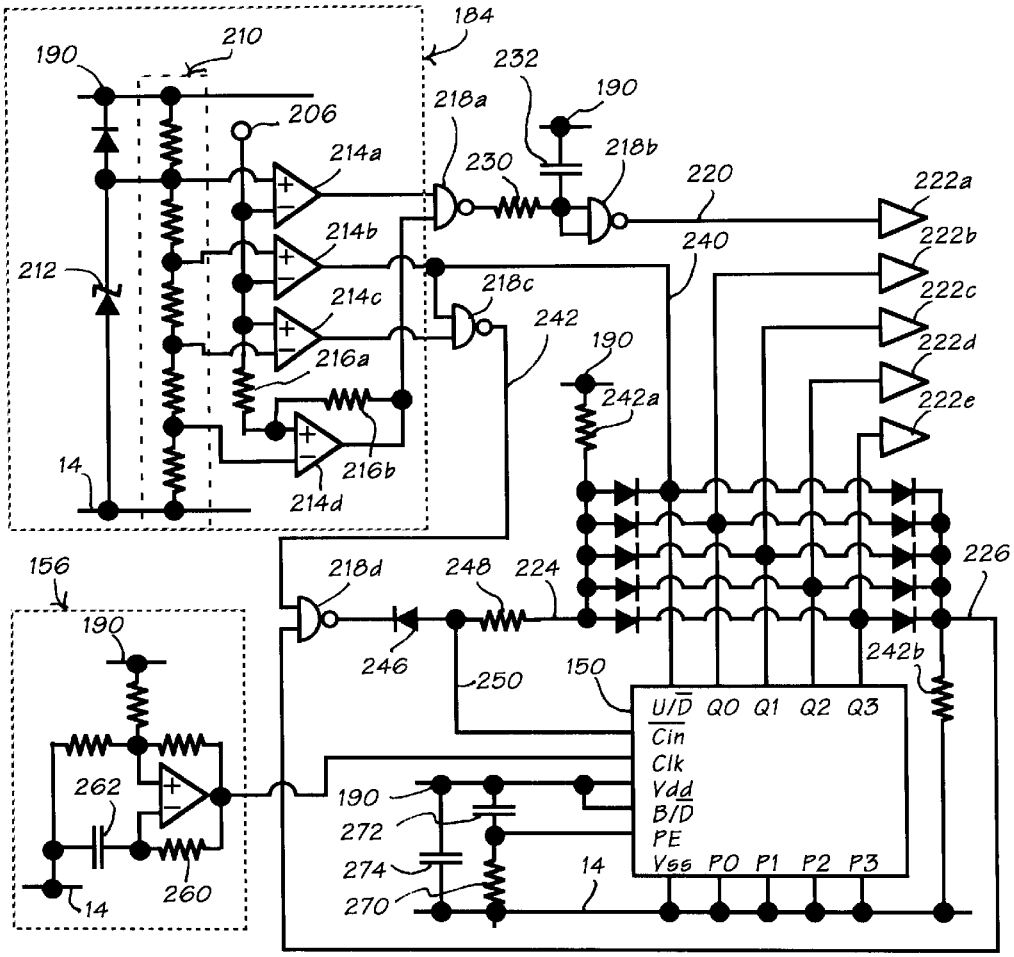

As shown in FIG. 10, DC voltage 206 is next compared with a set of four DC reference levels established by a voltage divider 210 in a voltage comparator circuit 184. From highest to lowest, these reference levels represent the maximum input voltage for a safe output, the upper and lower regulating levels, and the minimum input voltage for a safe output. A Zener diode 212, preferably rated around approximately five or six volts, stabilizes the reference voltages even at low AC input voltages when regulator 196 cannot establish a stable 12 volts on rail 190. For example, voltage divider 210 may be made up of resistors (from top to bottom) having values of 10 KΩ, 10 KΩ, 5.6 KΩ, 27 KΩ and 180 KΩ respectively, and diode 212 may be rated at 5.1 volts. The resulting reference voltages are then about 5.1, 4.9, 4.7 and 4.1 volts respectively.

Comparators 214*a* through 214*d* may be formed by LM324 or other single-supply operational amplifiers. To prevent cycling under load, resistors 216*a* and 216*b* are preferably used at the lowermost limit to provide hysteresis. Resistors 216*a* and 216*b* may, for example, have values of 470 KΩ and 10 MΩ respectively, giving thresholds of 4.4 volts as voltage 206 rises and 3.9 volts as it falls again. Care should be taken that the upper threshold resulting from hysteresis does not overlap the next higher threshold set by divider 210.

Logic gates 218*a* through 218*d,* which may be CMOS NAND gates such as the CD4011B or other suitable types, interpret the resulting signals. Gates 218*a* and 218*b* generate a logic high output 220 whenever the voltage at node 22 is within a safe range; this drives safety relay 160 through a buffer amplifier 222*a* whose makeup will be described below.

A resistor 230 and a capacitor 232 prevent output 220 from responding to brief deviations outside the safe range, especially the periods of zero voltage during transitions of relays 20*a* through 20*d,* so that relay 160 remains stable during such transitions. The RC time constant of these two components together is preferably on the order of one second or thereabouts. Capacitor 232 is connected to positive rail 190 rather than common/neutral 14, so that the output also remains low on initial power-up; if this were not so, relay 160 could close before the voltage at node 22 had been stabilized.

An output 240 of comparator 214*b* is applied to the U/D input of a CD4029B or equivalent, up/down counter 150 to determine the count direction. Output 240 is also combined with all four binary outputs Q1 through Q4 from counter 150 through AND and OR gates formed by resistors 242*a* and 242*b* and the diodes connected to lines 224 and 226 respectively. (Alternatively, conventional CMOS or other compatible type logic gates could perform the AND and OR functions.) Resistors 242*a* and 242*b* are preferably each in the range between 22 KΩ and 100 KΩ, inclusive; however, values outside this range may be useful depending on the selection of the other components of the apparatus. Resistors 242*a,* 242*b* function to make line 224 logic high only when signal 240 and all of counter 150's binary outputs are also at logic high, and logic low otherwise. Similarly, a line 226 will be logic low only when signal 240 and all the binary outputs are at logic low, and otherwise at logic high.

The outputs of comparators 214*b* and 214*c* are applied to logic gate 218*c* to generate an output signal 242 which is at logic high when the AC voltage at node 22 is outside the regulation range. Gate 218*d* performs a NAND operation between output signal 242 and a signal 226 so that when both inputs are high, an output 244 is at logic low. A diode 246 and a resistor 248 perform a further AND operation between signals 244 and 224, so that the resulting signal 250 is high only when signals 224 and 244 are both high. (For reliability, resistor 248 is preferably about ten times resistor 242*a*. Again, the same function could also be performed by conventional CMOS or other compatible type logic gates.) Signal 250 is then applied to the "Count In" ($C_{in}$, active low) input of counter 150, so that counting either up or down is enabled under the conditions set forth in Table 5.

TABLE 5

Control of Counter 150 by Comparator Inputs and Counter 150's Own Binary Outputs.

| Binary Count | Kh Signal 240 | Kl 214c Out | T1 Sig. 224 | T2 Sig. 226 | T3 Sig. 242 | $C_{in}$ Sig. 250 | Count Enabled? |
|---|---|---|---|---|---|---|---|
| 0000 | 0 (down) | 1 | 0 | 0 | 1 | 1 | No |
| xxxx | 0 (down) | 1 | 0 | 1 | 1 | 0 | Yes |
| 1111 | 0 (down) | 1 | 0 | 1 | 1 | 0 | Yes |
| 0000 | 1 (up) | 1 | 0 | 1 | 0 | 1 | No |
| xxxx | 1 (up) | 1 | 0 | 1 | 0 | 1 | No |
| 1111 | 1 (up) | 1 | 1 | 1 | 0 | 1 | No |
| 0000 | 1 (up) | 0 | 0 | 1 | 1 | 0 | Yes |
| xxxx | 1 (up) | 0 | 0 | 1 | 1 | 0 | Yes |
| 1111 | 1 (up) | 0 | 1 | 1 | 1 | 1 | No |

(Comparators 214*b* and 214*c* never give "zero" outputs at the same time. "xxxx" indicates any four-bit combination other than 0000 or 1111.)

Thus, counting is enabled except when either signal 240 and Q0 through Q3 are all zeros (preventing rollover past 0000 when counting downward), the same signals are all ones (preventing rollover past 1111 when counting upward), or the input voltage is between the regulation limits (so that an acceptable voltage is maintained). The circuit described above is only one of many possible ways of achieving this result, other circuits may also be suitable for use with the invention.

When enabled, counting is triggered by the rising edge (if counter 150 is a CD4029B or equivalent) of a periodic rectangular pulse or square wave generated by a clock circuit 156. This may be formed from spare logic gates or a spare operational amplifier in any of several well-known ways. For example, the operational-amplifier circuit shown in block 156 may be used. The output frequency is not especially critical, but is made as high as possible without introducing instability or overshoot. For example, a frequency in the range between 15–20 Hz may be useful. To achieve this with the circuit shown, for example, resistor 260 may be about 100 KΩ, capacitor 262 may be 0.47 μf, and the other resistors in the block may all be equal with any convenient value in the range from 100 KΩ to 1 MΩ, such as 270 KΩ.

Alternatively, resistor 260 may be made adjustable—for example, in the circuit shown resistor 260 may be a 200 KΩ or 250 KΩ trimpot—so that the count rate may be changed to accommodate the characteristics of varying types of switching devices. This feature would be especially useful in case the control circuitry were being offered by itself with the user providing the transformer and switching devices.

Counter 150, if a CD4029B or similar device, also has its preset inputs P0 through P3 so connected that, if input PE ("preset enable") is brought to logic high, Q0 through Q3 will take on the values of P0 through P3 respectively. This is done upon power-up (or after loss of power) through a resistor 270 and a capacitor 272, so that the step-up voltage ratio is brought up slowly from a minimum value rather than beginning at a higher and possibly dangerous level. Resistor 270 and capacitor 272 may, for example, have values of 820 KΩ and 0.1 μf, respectively.

Since false triggering of PE may occur upon relay transitions, another capacitor 274, having two or more times the capacitance of capacitor 272, is preferably added as close as possible to resistor 270 and capacitor 272 to bypass the power supply locally. Additional bypassing is desirably added by placing one or more other capacitors (not shown), totaling a few microfarads, between rails 14 and 190 wherever circuit layout makes this convenient.

Figure 11:
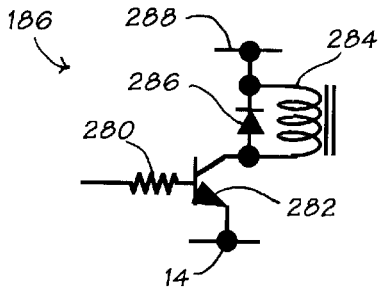

Each of buffer amplifiers 222*a* through 222*e* needs to be designed for the specific relay type being used, as in a circuit 186 shown in FIG. 11. The logic input signal is applied through a resistor 280 to the base of a transistor 282, whose emitter is connected to common rail 14. The collector is then connected to a relay coil 284, which is bypassed by a free-wheeling diode 286 (preferably a diode that is able to handle the maximum expected voltage and current). Relays are not driven from positive rail 190, and coil current does not pass through regulator 196, as this could create disturbances in the DC power which might upset other circuit functions. Instead, coil 284 is connected directly to a positive terminal 288 of capacitor 194.

For example, OMI-SS-212D relays may be used in circuit 186. These are DPDT relays with contacts rated at 250 volts, 5 amperes, and with 12-volt, 200-ohm coils; thus, the driving current for each relay is about 60 milliamperes. To drive these relays, resistor 280 is 10 KΩ, transistor 282 a 2N2222 type transistor, and diode 286 a 1N4001 diode.

A light-emitting diode (not shown) may optionally be placed as an indicator, either in series with resistor 280, or in series with a second resistor of lower value, the pair placed in parallel with coil 284 and diode 286 so that the LED glows when the coil is energized.

Where the control circuitry is meant to interface with a user's transformer and tap-selecting devices, the output may be of any type widely used in industry, such as a contact closure, current-loop output or open-collector output. Optionally, several such outputs may be provided for each relay, providing greater ease of use.

To prolong the lives of the relays or other switching devices, arc-suppression circuitry may be added between each pair of points involved in switching to absorb the energy stored in an inductive load, which would otherwise cause arcing between the contacts on opening. For example, a separate metal-oxide varistor (MOV) can be placed between the common and normally-open contacts of each relay used, and another between the common and normally-closed contacts. This approach, however, uses a great many MOVs, each of which is used only when its own particular set of contacts opens. Furthermore, since for any configuration of the contacts there are two relays connected in series on each side of the transformer, and since because of slight variations between the relays in such a pair one invariably opens slightly faster than the other, only the first-opening contact pair arcs. For arc suppression, therefore, the cluster containing the pair may be treated as a single, four-position switch or relay.

A second configuration of MOVs, therefore, might have one MOV placed between the common node of each tap-selecting device (as represented generally by multiposition switch 120*a* or 120*b* in FIG. 4) and each of the other nodes to which this MOV may be connected. For four-position tap-selecting devices, one located on the primary and one on the secondary side of the transformer as shown in the examples, this would reduce the number of MOVs needed to eight.

Figure 12:
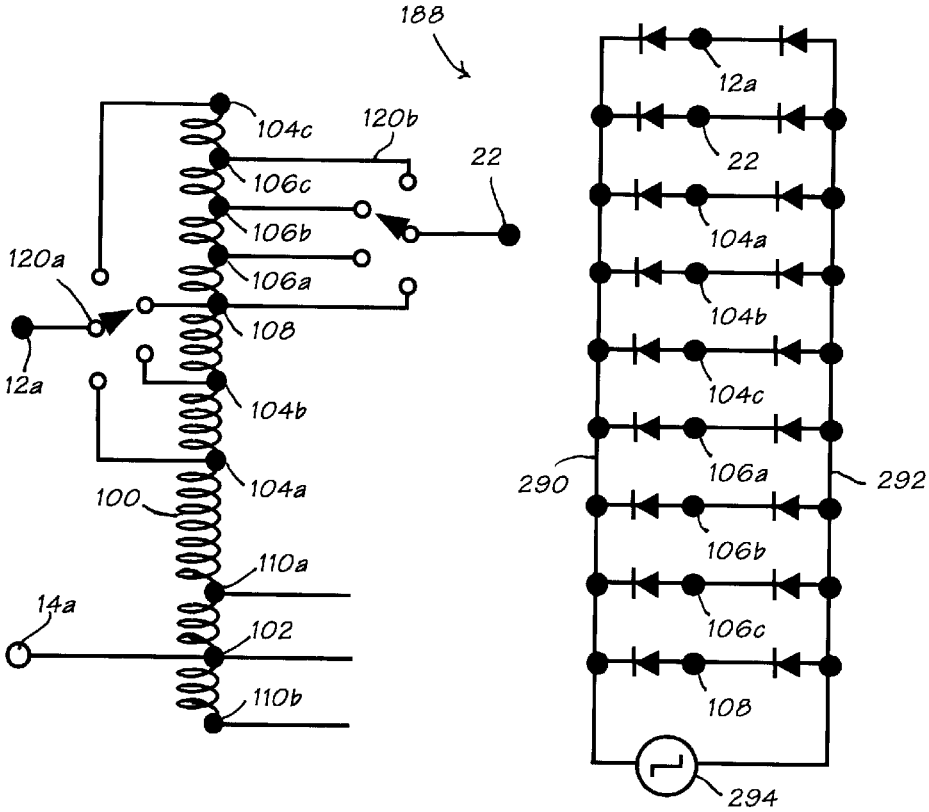

A further reduction is possible if a network of steering diodes is used so as to select the most positive and the most negative voltages present at any of these nodes. A single MOV may then be placed across the diode network, so as to prevent the maximum voltage between any pair of these nodes from exceeding a set limit. Such diode network 188 is shown in FIG. 12, where the transformer, switching arrangement and numbering system of FIG. 4 are repeated for clarity, but the arc suppression circuit 188 is shown separately. Nodes 12 and 22, representing the common nodes of the two tap-selecting devices, and nodes 104*a*, 104*b*, 104*c*, 106*a*, 106*b*, 106*c*, and 108, representing the possible nodes of connection, each have two diodes added, one diode with its anode facing the node and the other with its cathode facing it. The opposite ends of these diodes are connected together at two additional nodes 290 and 292: node 290 receiving the cathode ends, and node 292 the anode ends.

Node 290 thus takes on the most positive voltage, and node 292 the most negative voltage, present at any of these nodes. By connecting a suitably-chosen MOV 294 between these nodes, therefore, the entire set of relay contacts may be protected simultaneously.

The diodes used may be taken from the 1N400X series, where "X" is a digit representing the peak inverse voltage of the diode; such diodes, while rated for one ampere of continuous current, can withstand brief forward spikes of 50 amperes or more. For the 230-volt stabilizer used in the examples, with $R_n$=1.04 and $R_w$=1.17, diodes with PIV=200 volts or more (e.g., 1N4003's or 1N4004's) and an MOV with a breakdown voltage of 150 volts or more provide adequate protection. Heat dissipation in the MOV is minimal since it receives inductive spikes only when the relay contacts change position, at most 15 to 20 times a second.

Figure 13:
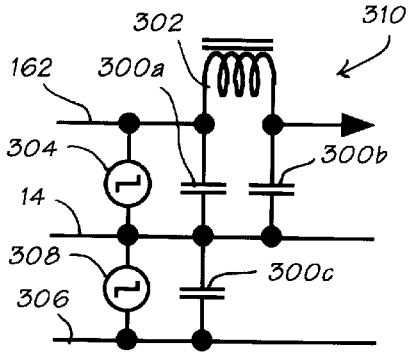

To minimize radio-frequency interference which might be generated during relay transitions and passed on to the load, a low-pass resonant filter is preferably added at the AC output. This may, for example, take the form of a resonant filter 192 shown in FIG. 13 in which two identical capacitors 300*a* and 300*b* and an inductor 302 form a simple "pi" network. For example, capacitors 300*a* and 300*b* may be 0.02 $\mu$f and 145 microhenries, respectively, for an overall resonant cutoff frequency of about 130 KHz.

Spike suppression is also conveniently added here by placing a metal-oxide varistor (MOV) 304 between hot output line 162 and neutral line 14. Optionally, one or more additional MOVs such as 308 may be placed between hot line 162 and either neutral line 14, ground line 306, or both.

The description above is given merely as an example of the invention, and should not be construed as limiting the scope of the invention. Many modifications to this basic circuit or to its constituent parts, performing the general functions described above, should now be apparent to any person of usual skill in the art of analog, digital and power electronic circuit design, and are therefore included within the scope of the invention.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. An apparatus for stabilizing an AC voltage, said apparatus comprising:

transformer means having primary means and secondary means;

input means for inputting an AC voltage to said primary means;

a plurality m of primary taps electrically connected to said primary means;

a plurality n of secondary taps electrically connected to said secondary means, said primary and secondary taps providing a plurality N=m*n of voltage ratios;

means for comparing said AC voltage to an optimum voltage; and tap selecting means for selecting one of said N voltage ratios and multiplying said AC voltage thereby to produce an output voltage near said optimum voltage.

2. The apparatus as recited in claim 1, wherein a plurality p of said primary and secondary taps are usable as both primary and secondary taps, and wherein N=(m*n−p+1).

3. The apparatus as recited in claim 1, wherein said transformer means includes a winding, and wherein said primary taps are placed at approximately logarithmic intervals along said winding.

4. The apparatus as recited in claim 1, wherein said transformer means includes a winding, and wherein said secondary taps are placed at approximately logarithmic intervals along said winding.

5. The apparatus as recited in claim 1, wherein said transformer means includes a winding, wherein said primary and secondary taps are placed at approximately logarithmic intervals along said winding, and wherein a spacing of said primary taps is greater than a spacing of said secondary taps.

6. The apparatus as recited in claim 1, wherein said transformer means includes has a winding, wherein said primary and secondary taps are placed at approximately logarithmic intervals along said winding, and wherein a spacing of said primary taps is smaller than a spacing of said secondary taps.

7. The apparatus as recited in claim 1, wherein said optimum voltage further comprises a voltage range, and wherein said selecting means further comprises means for selecting a voltage ratio that produces an output voltage within said voltage range.

8. The apparatus as recited in claim 1, further comprising voltage rectifying means in electrical connection with said transformer means.

9. The apparatus as recited in claim 1, further comprising voltage comparator means in electrical connection with said transformer means, said voltage comparator means having a maximum reference level corresponding to a maximum allowed input voltage, a minimum level corresponding to a minimum allowed input voltage, an upper voltage regulating level, and a lower voltage regulating level.

10. The apparatus as recited in claim 1, further comprising buffer amplifier means in electrical connection with said transformer means.

11. The apparatus as recited in claim 1, further comprising resonant filter means in electrical connection with said transformer means.

12. The apparatus as recited in claim 1, further comprising spike suppression means electrically connected to said output means.

13. An apparatus for stabilizing a varying AC voltage, said apparatus comprising:

input means for inputting an AC voltage;

a transformer having primary and secondary sides;

input means for inputting an AC voltage to said transformer;

a plurality m of primary taps electrically connected to said primary side;

a plurality n of secondary taps electrically connected to said secondary side, said primary and secondary taps providing a plurality N=m*n of voltage ratios;

a voltage comparator for comparing said AC voltage to an optimum voltage range; and means for selecting one of said N voltage ratios and multiplying said AC voltage thereby to produce an output voltage within said optimum voltage range.

14. The apparatus as recited in claim 13, wherein a plurality p of said primary and secondary taps are usable as both primary and secondary taps, and wherein N=(m*n−p+1).

15. The apparatus as recited in claim 13, wherein said transformer has a winding, and wherein said primary and secondary taps are placed at approximately logarithmic intervals along said winding.

16. The apparatus as recited in claim 15, wherein a spacing of said primary taps is greater than a spacing of said secondary taps.

17. The apparatus as recited in claim 15, wherein a spacing of said primary taps is smaller than a spacing of said secondary taps.

18. The apparatus as recited in claim 13, wherein said voltage comparator has a maximum reference level corresponding to a maximum allowed input voltage for producing a safe output voltage, a minimum level corresponding to a minimum allowed input voltage for a safe output voltage, an upper voltage regulating level, and a lower voltage regulating level, said upper and lower voltage regulating levels defining said optimum voltage range.

19. The apparatus as recited in claim 13, further comprising buffer amplifier means in electrical connection with said transformer.

20. The apparatus as recited in claim 13, further comprising resonant filter means in electrical connection with said transformer means.

* * * * *